US011517100B1

(12) United States Patent
Chan

(10) Patent No.: US 11,517,100 B1
(45) Date of Patent: Dec. 6, 2022

(54) STRAP ADJUSTMENT DEVICE

(71) Applicant: Duraflex Hong Kong Limited, Hong Kong (CN)

(72) Inventor: Yick Fai Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 17/347,763

(22) Filed: Jun. 15, 2021

(51) Int. Cl.
*A45F 3/00* (2006.01)
*A45F 3/04* (2006.01)

(52) U.S. Cl.
CPC ..... *A45F 3/047* (2013.01)

(58) Field of Classification Search
CPC ..... A45F 3/08; A45F 2003/142; A45F 3/00; A45F 3/02; A45F 3/04; A45F 3/042; A45F 2003/001; A45F 3/047; A45C 13/30; A44B 11/25; A44B 11/2592; A44B 11/2596; B60R 22/20; Y10T 24/47
USPC ..... 224/627
See application file for complete search history.

(56) References Cited

U.S. PATENT DOCUMENTS 6,460,746 B1 * 10/2002 Amram ..... A45F 3/047 224/628

FOREIGN PATENT DOCUMENTS

| | | | | |
|---|---|---|---|---|
| CN | 1101819 A | * | 4/1995 | ..... A41F 1/008 |
| DE | 20313471 U1 | * | 11/2003 | ..... A45F 3/042 |
| DE | 3634621 A1 | * | 12/2003 | |
| DE | 202015007090 U1 | * | 2/2017 | |
| JP | 2013215550 A | * | 10/2013 | |
| KR | 20060036184 A | * | 4/2006 | |
| KR | 20130107585 A | * | 10/2013 | |

* cited by examiner

*Primary Examiner* — Nathan J Newhouse
*Assistant Examiner* — Matthew T Theis
(74) *Attorney, Agent, or Firm* — Collard & Roe, P.C.

(57) ABSTRACT

A strap adjustment device has a retaining body and a strap connector adjustably mounted in the retaining body. The retaining body has an interior cavity and a top opening extending in a horizontal direction, and at least one protrusion extending into the cavity. The strap connector has a strap connecting portion with at least one strap connecting element, and an adjustment portion disposed inside the cavity. The adjustment portion has a lower locking element and a spring mounted its end. When the spring is in a relaxed state, the protrusion prevents movement of the strap connector in the horizontal direction by blocking the lower locking element. Pressing the strap connector against the force of the spring moves the lower locking element below the protrusion, so that the strap connector can be moved in the horizontal direction to a new position within the retaining body.

15 Claims, 10 Drawing Sheets

STRAP ADJUSTMENT DEVICE

BACKGROUND OF THE INVENTION

1. Field of the Invention

This invention relates to a device that allows for adjustment of the position of straps on a device. In particular, the invention relates to a device that allows the user to adjust the space between two straps on an article.

2. The Prior Art

Straps on luggage and backpacks typically have set positions on the luggage or backpack, so that the distance between the straps is always fixed. This can make the backpack difficult to use for people whose bodies do not exactly fit the set width between the straps. This requires manufacturers to produce the items in several different sizes to fit different body types. It would be desirable to devise a system where the spacing between two straps on a device can be adjusted to account for users of different sizes.

SUMMARY OF THE INVENTION

It is therefore an object of the invention to provide a device for attaching a strap to an article, in which the lateral positioning of the strap on the article can be adjusted in a simple manner, so that the straps can be positioned wider or narrower relative to each other, depending on the size of the user. This object is accomplished by a strap adjustment device formed from a retaining body into which a strap connector is adjustably secured. The retaining body comprises a front wall, a rear wall, side walls, an interior cavity and a top opening extending in a horizontal direction. At least one of the front wall or rear wall contains at least one protrusion extending into the cavity. The strap connector comprises a strap connecting portion with at least one strap connecting element, and an adjustment portion disposed inside the cavity of the retaining body. The adjustment portion has at least one lower locking element and a distal end with a spring mounted on the distal end. The spring is preferably a coil spring. The spring is arranged so that the strap connector can be moved lower into the cavity by pressing on the strap connector against the force of the spring, toward the distal end. Releasing the downward pressure on the strap connector moves the strap connector back into a raised position, with the spring in a relaxed state. When the spring is in a relaxed state, the at least one protrusion on the retaining body prevents movement of the strap connector in the horizontal direction by blocking the at least one lower locking element from passing by the protrusion. Pressing the strap connector against the force of the spring moves the lower locking element below the protrusion, so that the strap connector can be moved in the horizontal direction to a new position within the retaining body, wherein the spring can then be released to position the strap connector in its new position.

Preferably, there are at least two protrusions disposed along a horizontal extent of the retaining body, such that the strap connector can be moved between three different positions in the cavity by pressing the strap connector to compress the spring and sliding the strap connector within the cavity, to clear the protrusions.

To lock the strap connector more securely in place, the strap connector can have two lower locking elements, with one of the lower locking elements being disposed on a side facing the front wall and another of the lower locking elements being disposed on a side facing the rear wall. The retaining body then has two protrusions on each of the front wall and rear wall for each of the horizontal locations, with the protrusions on the front wall facing the protrusions on the rear wall. In the preferred embodiment, there are thus four protrusions, with the two protrusions on the front wall facing the two protrusions on the rear wall.

In order to keep the strap connector from being pulled out of the retaining body when it is under tension from a strap, there is at least one lower locking ledge on the adjustment portion that interacts with the at least one lower locking element when the strap connector is pulled in a direction opposite the spring, to prevent the strap connector from being removed from the retaining body. The lower locking ledge extends across the entire width of the retaining body, so that it prevents inadvertent disengagement of the strap connector when the strap connector is in any of the positions along the retaining body. Preferably, there are two lower locking ledges that extend inward from each of the front and rear walls of the retaining body, and two lower locking elements on the strap connector. The protrusions on the retaining body extend downward from the lower locking ledges.

To add even more stability and strength under tension, the strap connector can have an upper locking element that interacts with at least one upper locking protrusion on the retaining body. Preferably, the upper locking element is an indentation in the adjustment portion, and the at least one upper locking protrusion seats in the indentation and further prevents removal of the strap connector from the retaining body when the strap connector is pulled in the direction opposite the spring. The two levels of locking from the lower locking elements and lower locking ledge, as well as from the upper locking protrusion and upper locking element make the device according to the invention able to withstand large amounts of tension, and prevents the strap connector from being pulled out of the retaining body, even when the tension is applied at various different angles. In fact, the greater the tension from a strap, the tighter the upper locking protrusion is pressed into the indentation in the strap connector, which then creates and even more secure connection.

The spring tension also keeps the strap connector securely connected to the retaining body because in the relaxed state, the spring presses the upper locking elements against the upper locking protrusions, and presses the lower locking elements against the lower locking ledges, to prevent movement of the strap connector within the retaining body. This also prevents any horizontal movement of the strap connector during use due to the friction between the parts.

Preferably, there is a cap covering the spring. The cap slides along the adjustment portion during compression and release of the spring.

The strap connecting element can take any suitable form. For example, the strap connecting element could be formed from a single bar separated from the rest of the strap connector by a slot, it could be formed by multiple bars and slots, or could form a D-ring. Other types of strap connecting devices could also be used.

The retaining body is configured to be permanently attached to a strap or article. In one embodiment, the rear wall of the retaining body extends beyond the perimeter of the front wall and is formed of a sewable material, so that it can be sewn directly to a strap or fabric article. In another embodiment, the rear wall has at least one slot for attachment of webbing, that can be sewn into a closed loop or closed by another buckle.

In order to have a simple assembly of the strap adjustment device, the front wall and side walls of the retaining body can be formed from a single piece unitary housing part that is snapped onto the rear wall after insertion of the strap connector. This way, the device can be disassembled by snapping off the front wall from the rear wall, yet after assembly keeps the strap connector securely within the retaining body. In another embodiment, the front and rear walls can be formed of a single piece, with a bottom cover that can be snapped on and off to allow for insertion of the strap connector.

The invention also relates to an article having two of the strap adjustment devices described above. The strap adjustment devices are arranged on the article in such a manner that a spacing of the strap connectors relative to each other, and thus the straps to which they are connected, is adjustable by moving the strap connectors in the horizontal direction within the retaining bodies. The article can be any suitable article, such as a backpack, infant carrier, luggage or other item that requires carrying.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
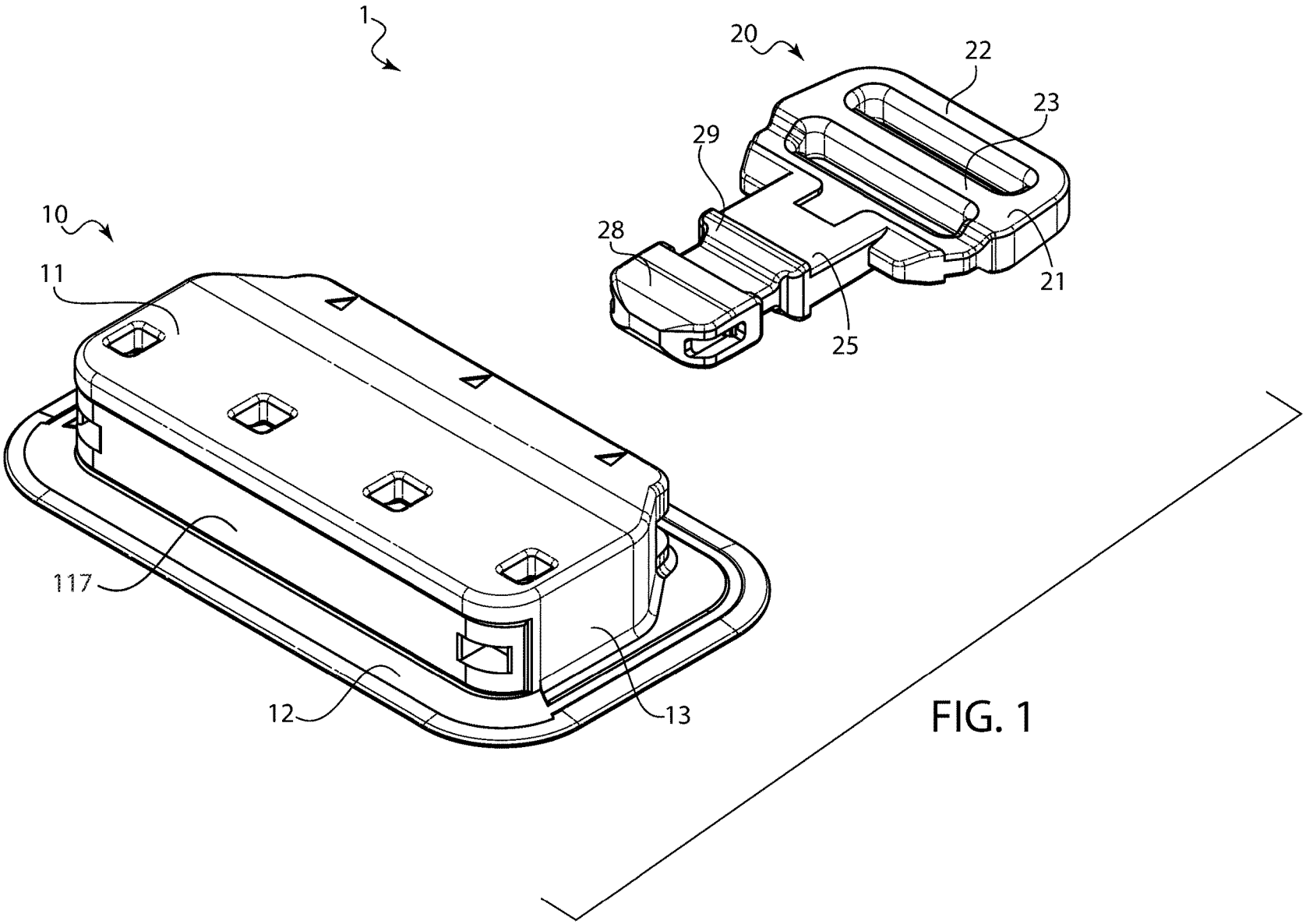
- FIG. 1 shows an exploded view of the strap adjustment device according to the invention.
Figure 4:
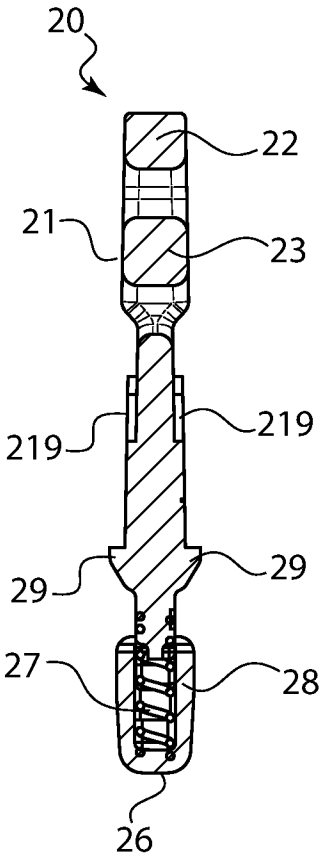
- FIG. 4 shows a cross-sectional view along lines IV-IV of FIG. 2.
Figure 3:
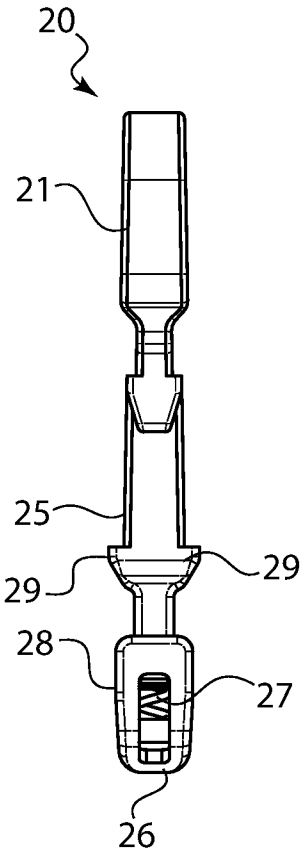
- FIG. 3 shows a side view of the strap connector portion.
Figure 2:
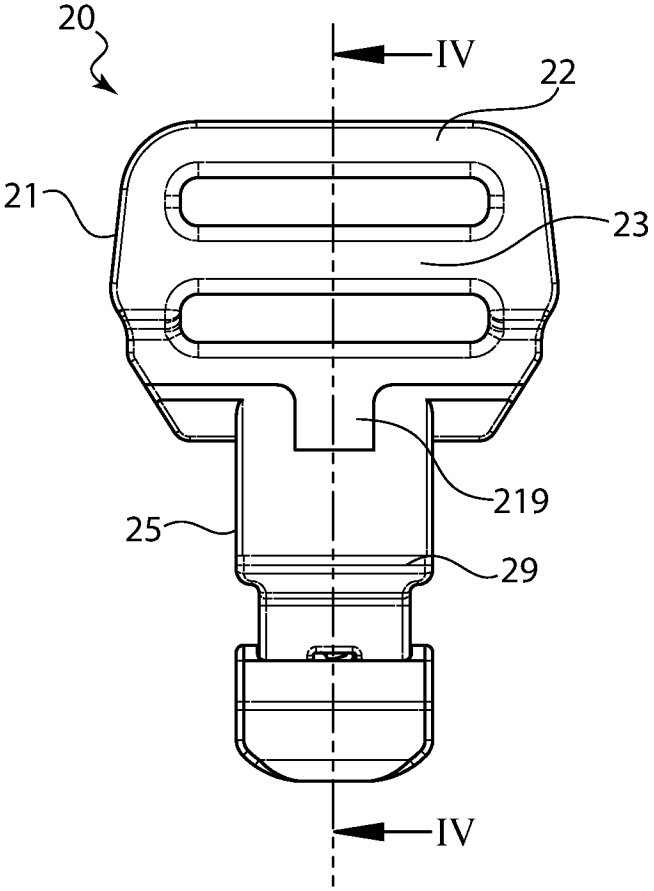
- FIG. 2 shows a front view of the strap connector portion.
Figure 6:
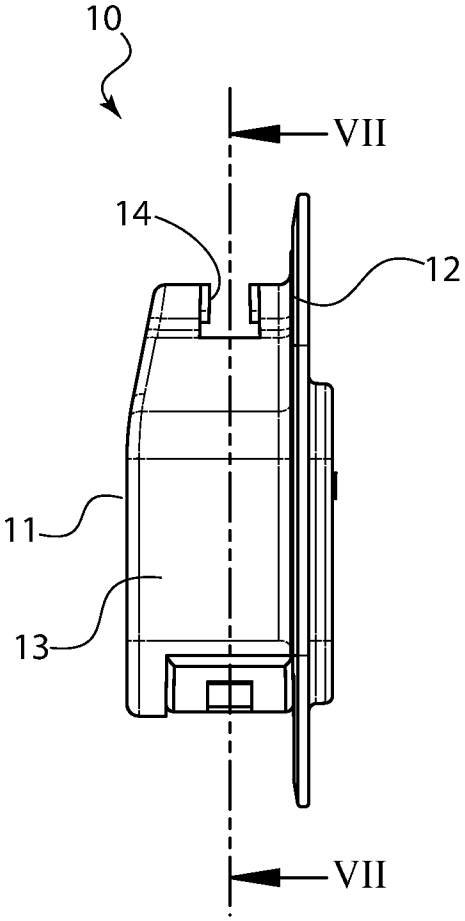
- FIG. 6 shows a side view of the retaining body.

Referring now in detail to the drawings, FIG. 1 shows an exploded view of the strap adjustment device, 1, which is formed by a retaining body 10 and a strap connector 20, which locks into retaining body 10 to connect two articles together. As shown in FIGS. 1-4, strap connector 20 is formed from a strap connecting portion 21 and an adjustment portion 25 which is configured for insertion into retaining body 10. Strap connecting portion 21 has two strap retaining bars 22, 23 separated by slots, to allow the attachment of a strap that can be longitudinally adjusted around the bars 22, 23. Other types of strap-connecting elements could also be used, such as a single bar. Adjustment portion 25 has a distal end 26 to which a sprig 27 is connected. A cover element 28 is formed over the spring and moves up and down adjustment portion 25 as the spring is compressed and released. Strap connector 20 also has upper and lower locking elements which are configured to lock strap connector 20 to retaining body 10 during use. The lower locking elements are formed by protrusions 29 that extend from the front and rear sides of the adjustment portion, and the upper locking elements are formed by indentations 219 in an upper part of the adjustment portion, just below strap connecting portion 21.

Figure 5:
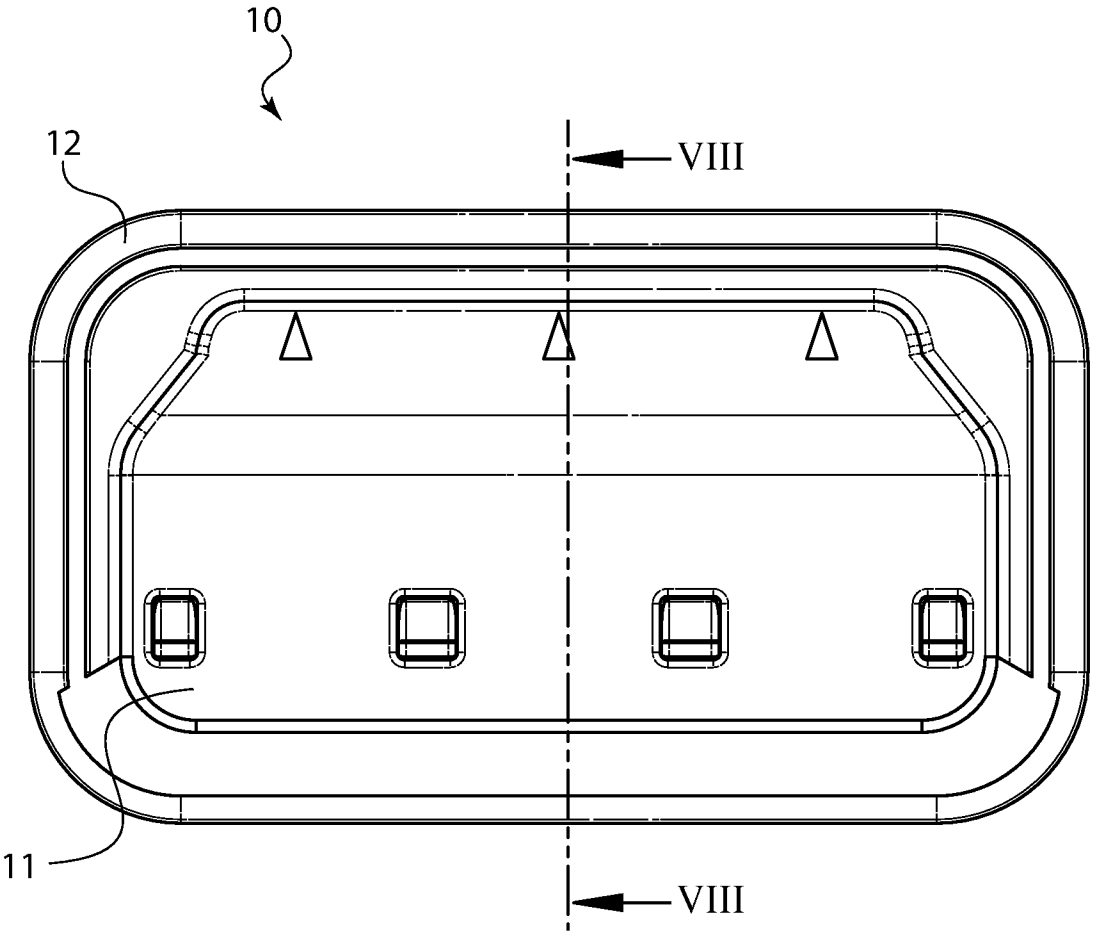
- FIG. 5 shows a front view of the retaining body.
Figure 8:
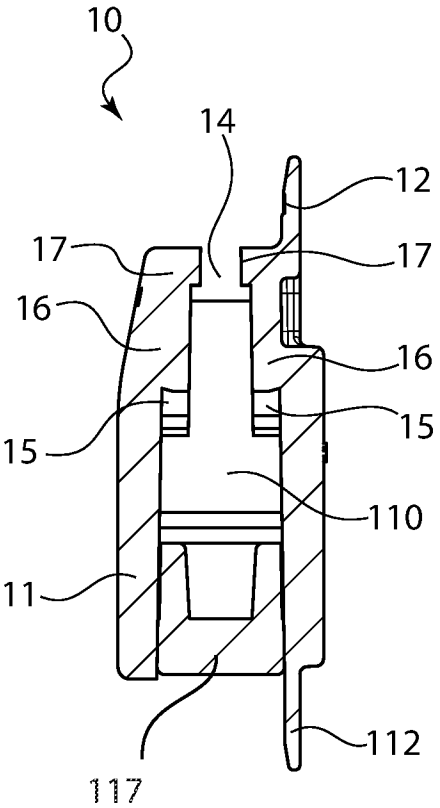
- FIG. 8 shows a cross-sectional view of the retaining body along lines VIII-VIII of FIG. 5.
Figure 7:
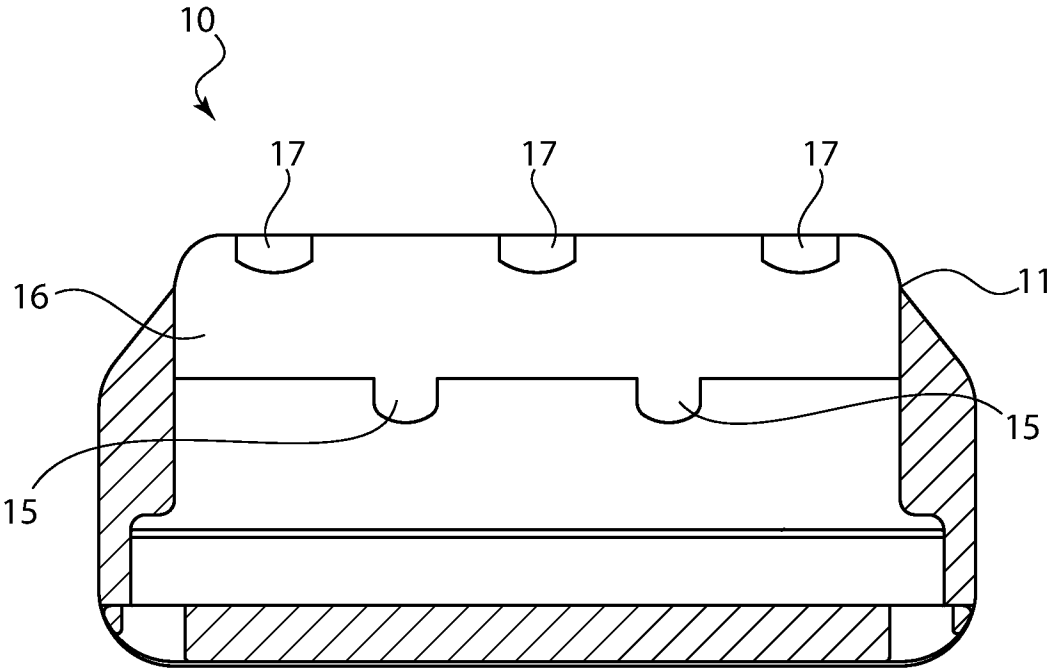
- FIG. 7 shows a cross-sectional view of the retaining body long lines VII-VII of FIG. 6.

FIGS. 1 and 5-8 show retaining body 10. Retaining body 10 has a front wall 11, a rear wall 12, side walls 13, bottom cover 117 and an elongated top opening 14. Cross-sections of the interior portions are shown in FIGS. 7 and 8. As shown in FIG. 7, which is the interior of the front wall 11 of retaining body 10, a lower locking ledge 16 is formed, which extends into the cavity 110 in retaining body 10. Extending from lower locking ledge 16 are a series of protrusions 15, spaced across the width of front wall 11. Rear wall 12 also has lower locking ledge 16 and protrusions 15, facing the lower locking ledge 16 and protrusions 15 on front wall 11, as shown in FIG. 8. Along the top edge of front wall 11 are a series of upper locking protrusions 17, spaced in between protrusions 15 along the width of front wall 11. Rear wall 12 also has the same upper locking protrusions 17, facing upper locking protrusions 17 on front wall 11. As shown in FIGS. 5 and 8, rear wall 12 extends beyond the perimeter of front wall 11 and forms a lip 112 that can be used to attach retaining body 10 to an object, such as a fabric strap or portion of luggage. The lip 112 of rear wall 12 can be made of a sewable material so that it can be directly sewn on to an article.

Figure 9:
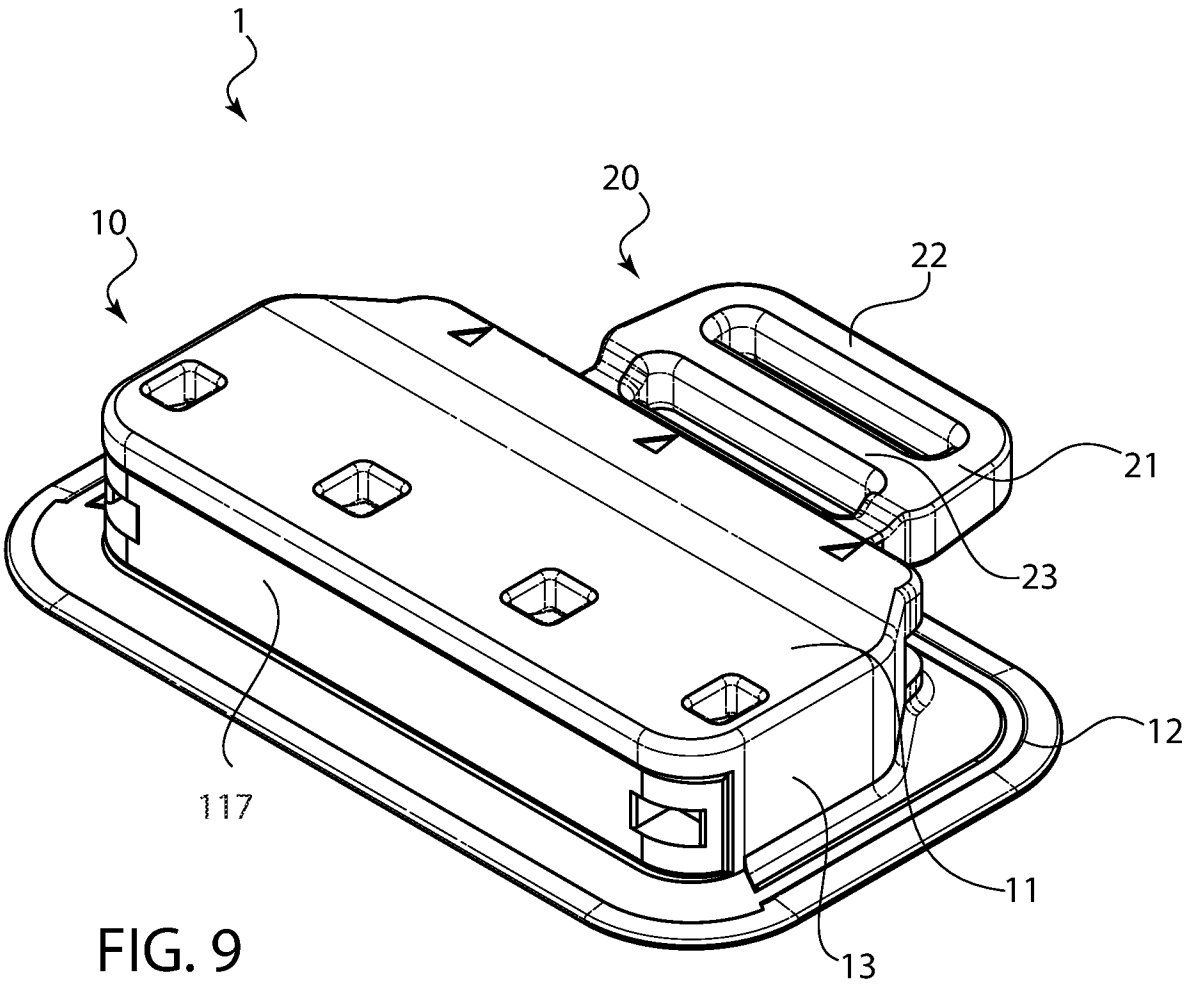
- FIG. 9 shows a perspective of the assembled strap adjustment device.
Figure 11:
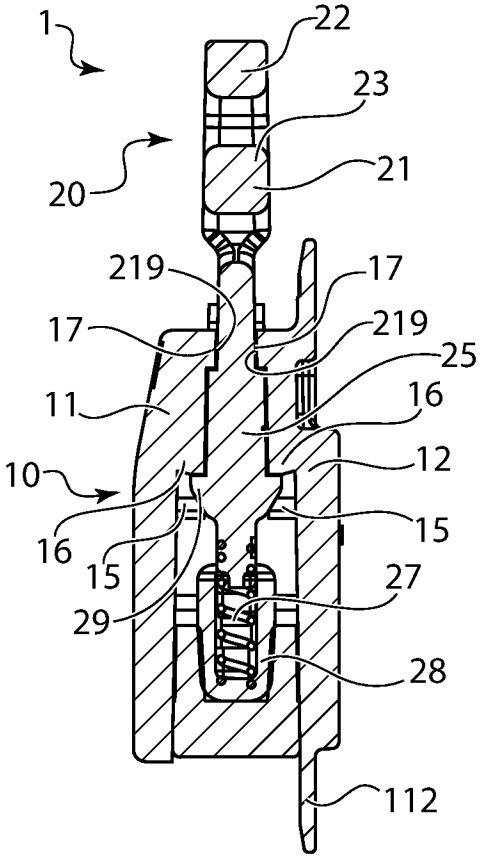
- FIG. 11 shows a cross-sectional view along lines XI-XI of FIG. 10.
Figure 10:
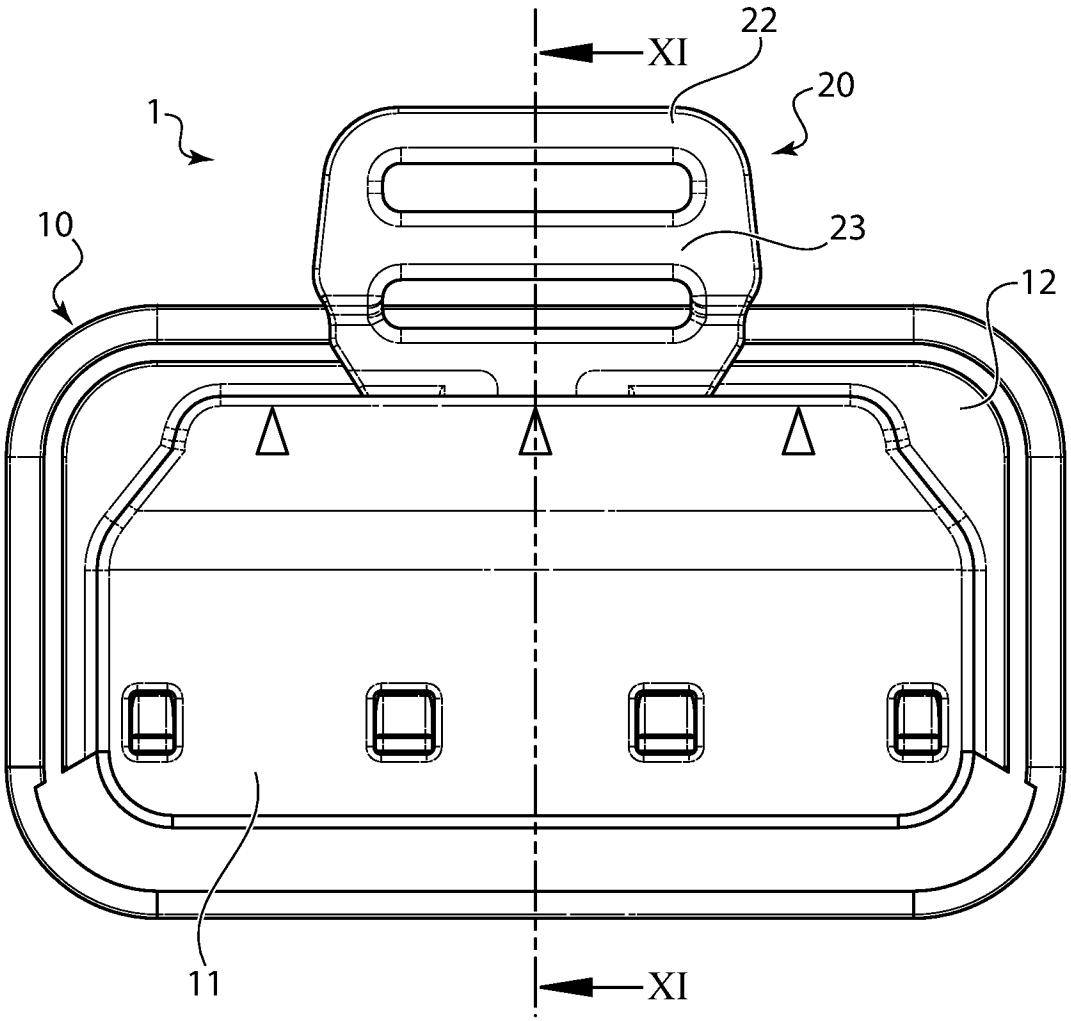
- FIG. 10 shows a front view of the assembled strap adjustment device.

The assembled strap adjustment device 1 is shown in FIGS. 9-11. Here, strap connector 20 is inserted into cavity 110 of retaining body 10 by removing cover 117, and is locked in place by snapping cover 117 onto retaining body 10. Alternatively, (not shown) the front and rear of the retaining body 10 can be formed separately so that strap connector 20 is placed on top of rear wall 12 and then a unit formed of front wall 11 and side walls 13 is snapped in place on top, securing strap connector 20 inside. The cover 117 (or unit in the alternative embodiment) can be snapped off in case cleaning is needed, but prevents strap connector 20 from escaping once it is locked in place.

As can be seen in the cross-sectional view in FIG. 11, which shows the assembled device in a relaxed state of the spring, the protrusions 29 of strap connector 20 abut the lower locking ledge 16 of retaining body 10 to prevent the strap connector 20 from being pulled out of the retaining body 10 when under stress by a strap connected to strap connecting portion 21. In addition, one of the upper locking protrusions 17 on each side of retaining body 10 are seated in indentations 219 of strap connector 20, to provide further resistance to the strap connector 20 being pulled out of retaining body 10. This double locking provides a very secure and strong device that can be used for many applications.

Figure 12B:
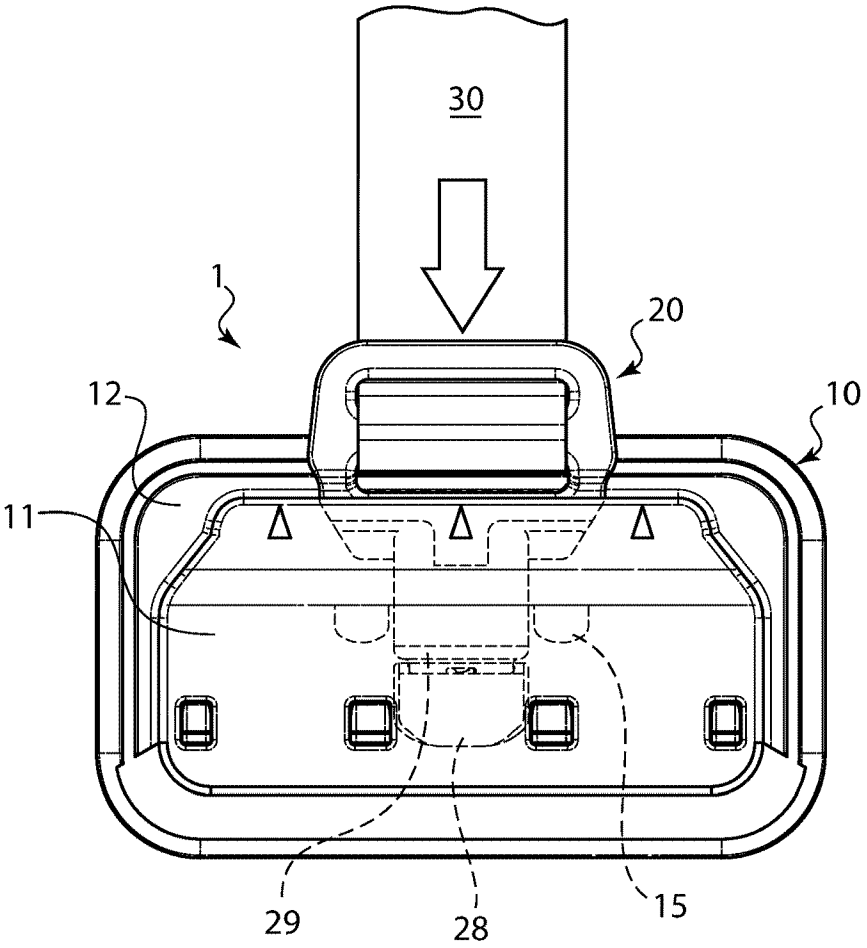
- FIGS. 12*a*-12*d* show the three different adjustment positions of the strap connector in the retaining body, as well as the tensioned and relaxed state of the spring.
Figure 12A:
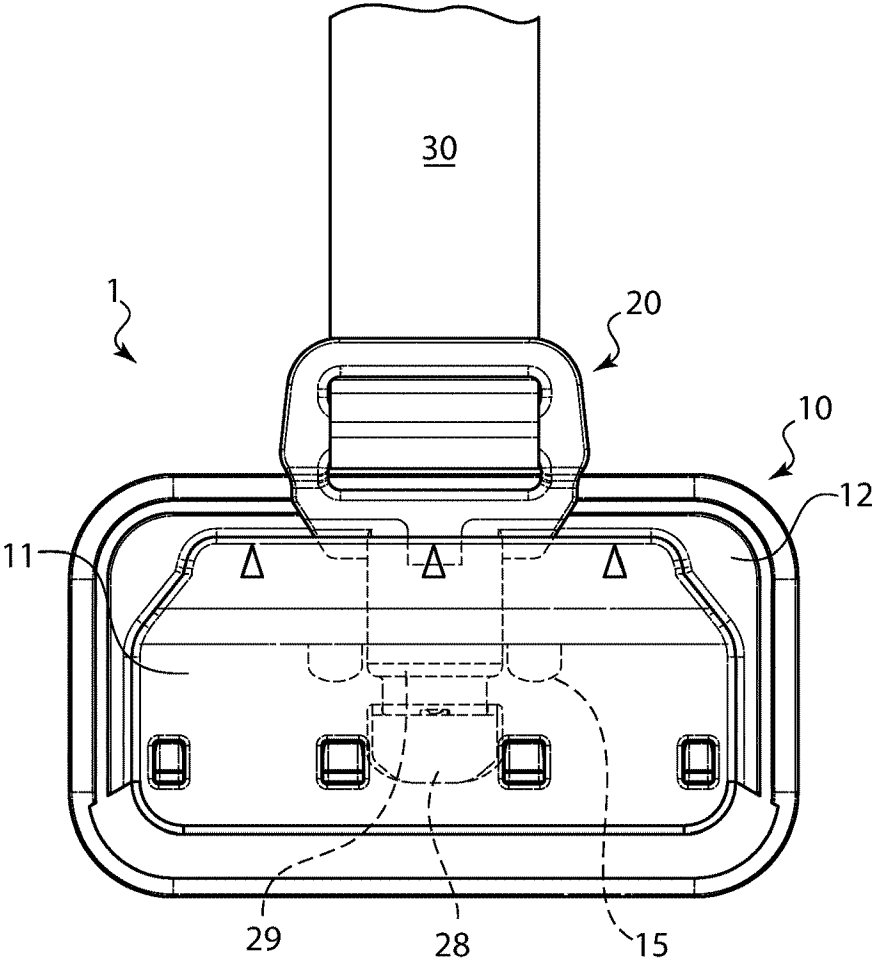
Figure 12D:
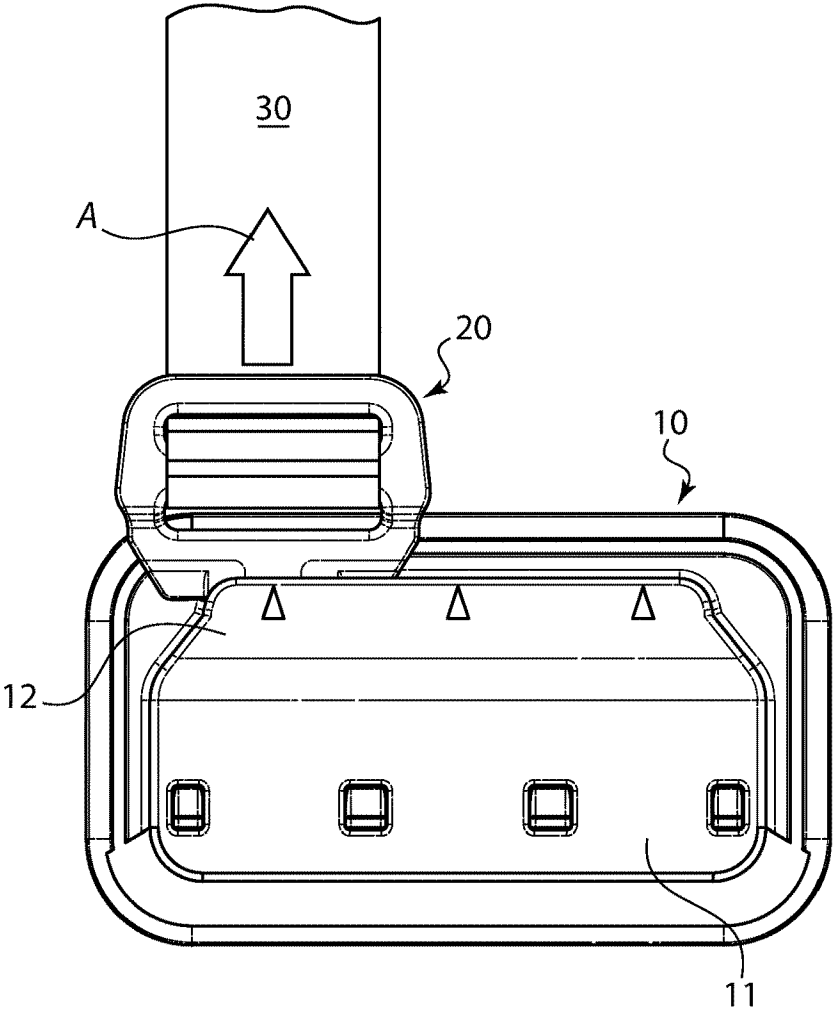
Figure 12C:
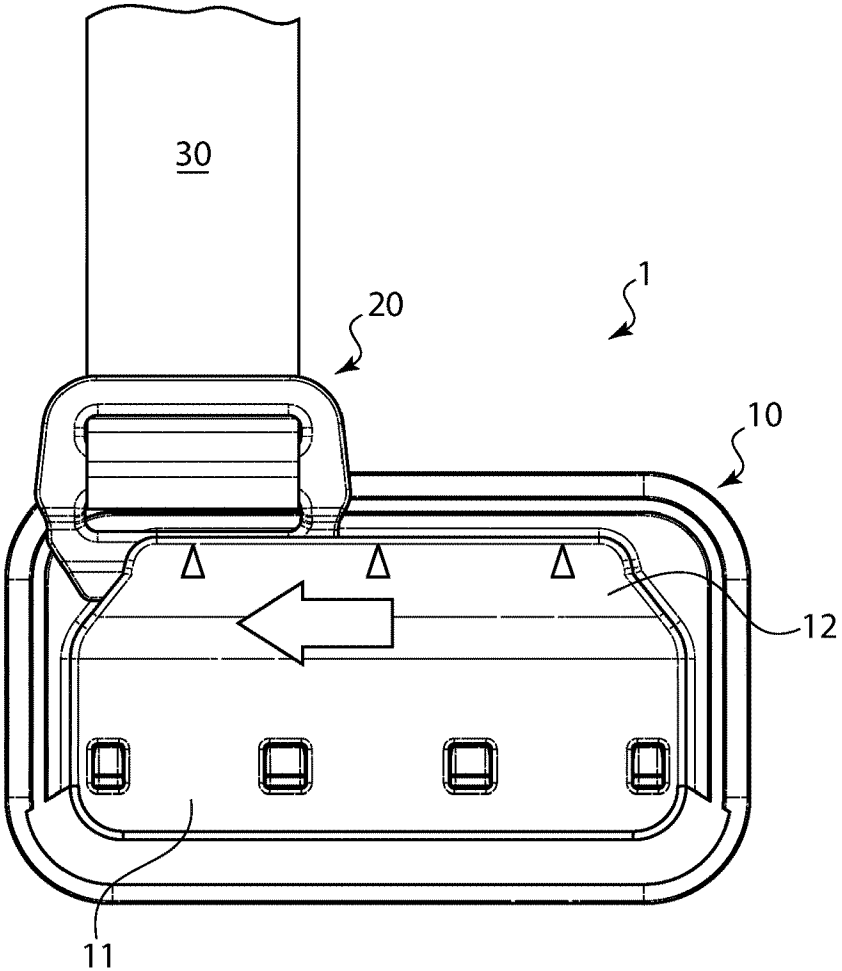

The horizontal adjustment of strap adjustment device 1 is shown in FIGS. 12A-12D. In the position shown in FIG. 12A, the strap connector 20 is located between protrusions 15, as shown in broken lines here. Protrusions 15 abut lower locking ledge 29 of strap connector 20 and prevent strap connector 20 from sliding horizontally along the cavity 110 of retaining body 10. To move strap connector 20 to a different position, either to the right or the left, a user presses down on strap connector 20, as shown in FIG. 12B, which compresses spring 27 and moves lower locking ledge 29 below the level of protrusions 15. This allows strap connector 20 to slide in either direction until lower locking ledge clears protrusions 15, such as shown in FIG. 12C, where strap connector 20 is now located to the left of the left-most protrusion 15 in retaining body 10. When strap connector 20 is positioned in the desired location, the user releases strap connector 20, which allows spring 27 to return to the relaxed state, as shown in FIG. 12D. In the relaxed state, which is illustrated in FIGS. 11 and 12A as well, strap connector 20 is locked in position and cannot move horizontally and cannot be pulled out of retaining body 10, even under force by a strap 30 being pulled in the direction of arrow A.

Figure 13:
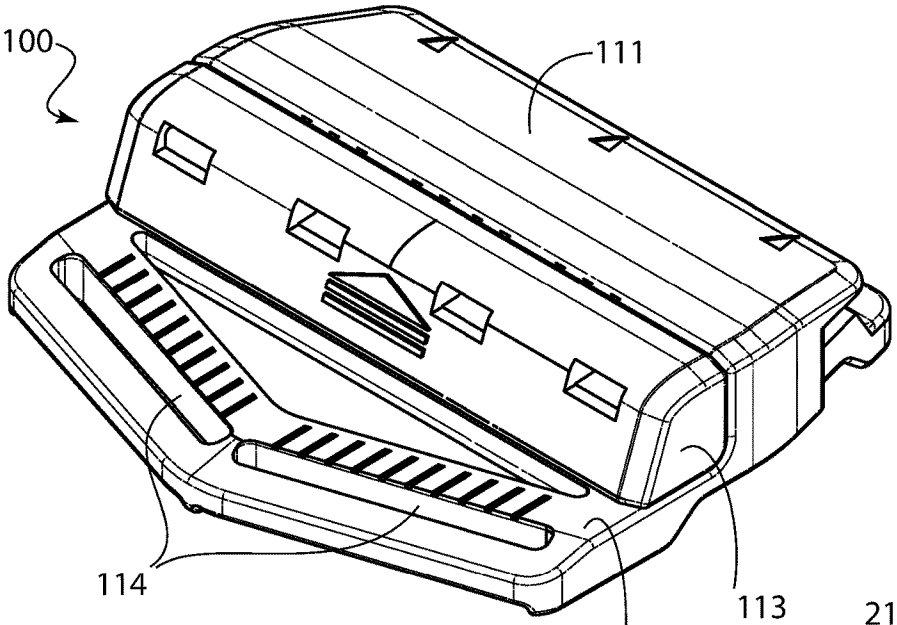
- FIG. 13 shows a perspective view of another embodiment of the retaining body for use in the strap adjustment device according to the invention.
Figure 15:
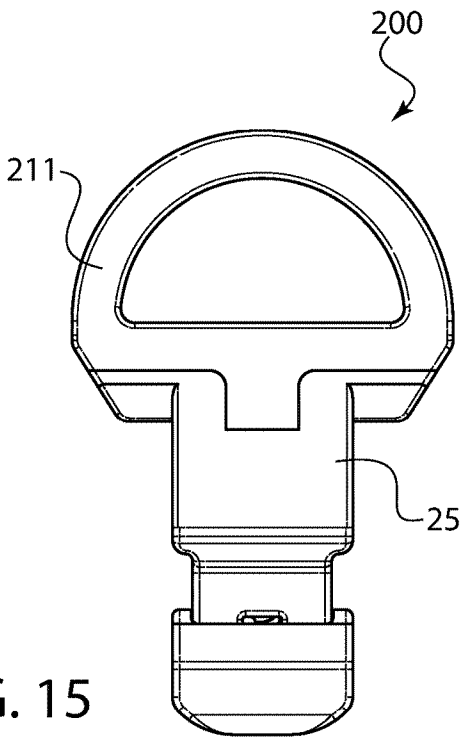
- FIG. 15 shows an alternative embodiment of the strap connector for use in the strap adjustment device according to the invention.
Figure 14:
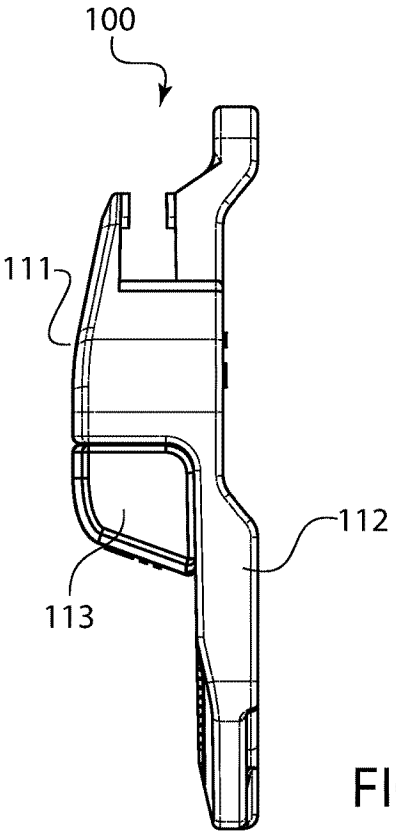
- FIG. 14 shows a side view of the retaining body of FIG. 13.

Alternative embodiments of the strap adjustment device are shown in FIGS. 13-15. In FIGS. 13 and 14, a retaining body 100, having a front wall 111 and a rear wall 112 can be used. Front wall 111 and rear wall 112 can be formed of a single piece, with a snap-on bottom section 113 to allow for insertion of the strap connector 20. Instead of or in addition to the sewable rear wall 112 as with the previous embodiment, strap connecting slots 114 can be placed on rear wall 112 to allow attachment of straps here as well.

FIG. 15 shows an alternative embodiment of a strap connector 200. Here, instead of strap connecting bars, the strap connecting portion 211 is formed as a D-ring. This allows additional items to be attached to strap connector 200 through the use of clips that would not normally fit through strap connecting bars 22, 23 in the embodiment of FIG. 1. Adjustment portion 25 can be formed identical to the adjustment portion 25 of FIGS. 1-12.

Figure 16:
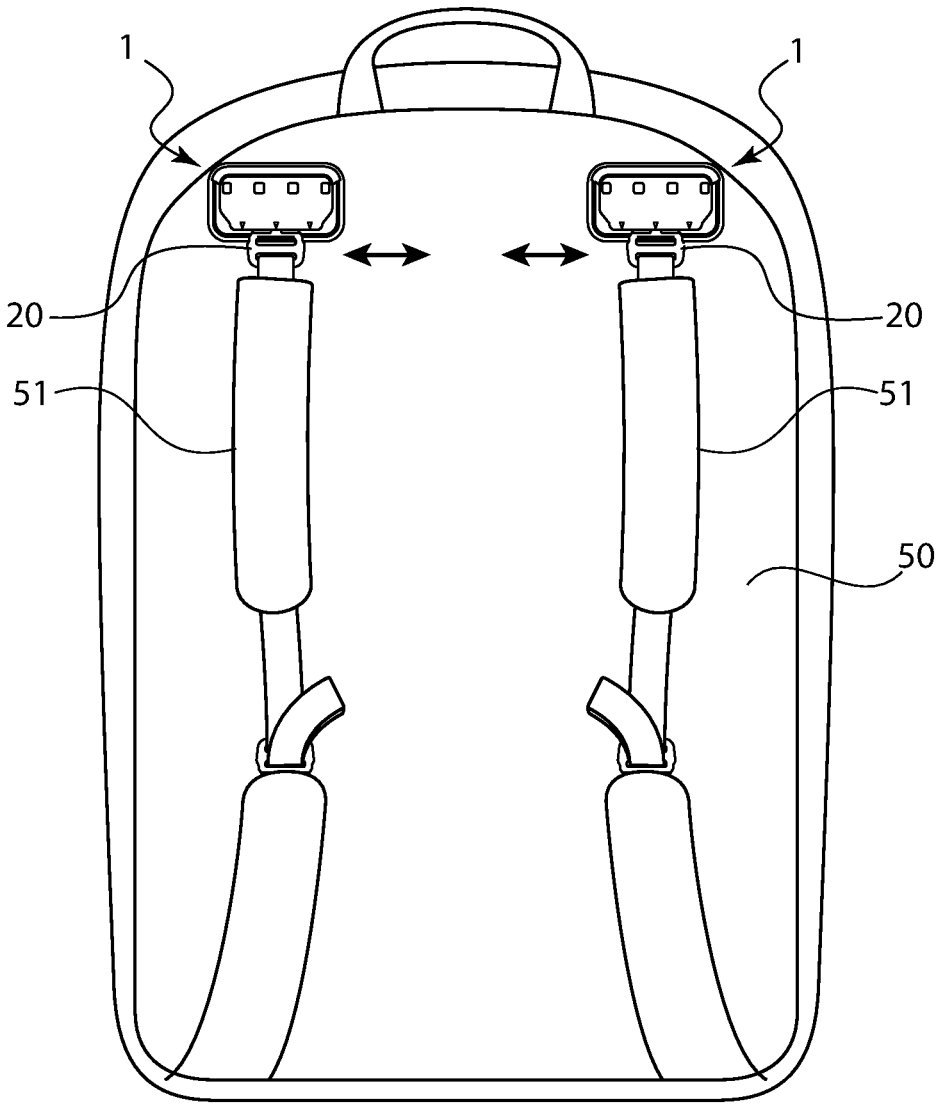
- FIG. 16 shows a backpack with two of the strap adjustment devices according to the invention.

FIG. 16 shows the strap adjustment device 1 in use on a backpack 50. As can be seen, a strap adjustment device 1 is used on each of the shoulder straps 51 of backpack 50. The distance between the straps 51 can be adjusted by moving the strap connectors 20 to the left or the right as illustrated in FIGS. 12A-12D.

The present invention provides a simple, effective and reliable device that allows for the connection of two straps or other articles together, while providing a unique horizontal adjustability to accommodate users of all sizes.

Accordingly, while only a few embodiments of the present invention have been shown and described, it is obvious that many changes and modifications may be made thereunto without departing from the spirit and scope of the invention.

What is claimed is:

1. A strap adjustment device comprising:

a retaining body comprising a front wall, a rear wall, side walls, an interior cavity and a top opening extending in a horizontal direction; wherein at least one of the front wall or rear wall contains at least one protrusion extending into the cavity;

a strap connector comprising a strap connecting portion with at least one strap connecting element, and an adjustment portion disposed inside the cavity, the adjustment portion having at least one lower locking element and a distal end with a spring mounted thereon; and a bottom cover connected to the retaining body, wherein when the spring is in a relaxed state, the at least one protrusion prevents movement of the strap connector in the horizontal direction by blocking the at least one lower locking element, wherein pressing the strap connector against a force of the spring moves the lower locking element below the at least one protrusion, so that the strap connector can be moved in the horizontal direction to a new position within the retaining body, wherein the front wall, rear wall and side walls of the retaining body form a single piece unitary body, and wherein the bottom cover is snapped onto the unitary body after insertion of the strap connector.

2. The strap adjustment device according to claim 1, wherein there are at least two protrusions, such that the strap connector can be moved between three different positions in the cavity by pressing the strap connector to compress the spring and sliding the strap connector within the cavity, to clear the protrusions.

3. The strap adjustment device according to claim 2, wherein the at least one lower locking element comprises two lower locking elements, with one of the lower locking elements being disposed on a side facing the front wall and another of the lower locking elements being disposed on a side facing the rear wall, and wherein the retaining body has two of said protrusions on each of the front wall and rear wall, with the protrusions on the front wall facing the protrusions on the rear wall.

4. The strap adjustment device according to claim 1, further comprising at least one lower locking ledge on the retaining body that interacts with the at least one lower locking element when the strap connector is pulled away from the top opening, to prevent the strap connector from being removed from the retaining body.

5. The strap adjustment device according to claim 4, further comprising an upper locking element on the strap connector and at least one upper locking protrusion on the retaining body, the upper locking element comprising an indentation in the adjustment portion, wherein the at least one upper locking protrusion seats in the indentation and further prevents removal of the strap connector from the retaining body when the strap connector is pulled away from the top opening.

6. The strap adjustment device according to claim 5, wherein the adjustment device is configured such that in the relaxed state, the spring presses the upper locking element against the at least one upper locking protrusion, and presses the at least one lower locking element against the at least one lower locking ledge, to prevent movement of the strap connector within the retaining body.

7. The strap adjustment device according to claim 1, further comprising a cap covering the spring, the cap moving along the adjustment portion during compression and release of the spring.

8. The strap adjustment device according to claim 1, wherein the at least one strap connecting element comprises at least one strap connecting bar and an opening.

9. The strap adjustment device according to claim 1, wherein the at least one strap connecting element comprises a D-ring.

10. The strap adjustment device according to claim 1, wherein the rear wall of the retaining body comprises a sewable plate having edges that extend beyond the side walls of the retaining body.

11. The strap adjustment device according to claim 1 wherein the back wall of the retaining body. has at least one slot for attachment of webbing.

12. The strap adjustment device according to claim 1, wherein the spring is a coil spring.

13. An article having a main body and two of the strap adjustment devices according to claim 1 attached thereto in such a manner that a spacing of the strap connectors relative to each other is adjustable by moving the strap connectors in the horizontal direction within the retaining bodies.

14. The article according to claim 13, wherein the main body comprises a backpack.

15. A strap adjustment device comprising:

a retaining body comprising a front wall, a rear wall, side walls, an interior cavity and a top opening extending in a horizontal direction; wherein at least one of the front wall or rear wall contains at least one protrusion extending into the cavity;

a strap connector comprising a strap connecting portion with at least one strap connecting element, and an adjustment portion disposed inside the cavity, the adjustment portion having at least one lower locking element and a distal end with a spring mounted thereon;

at least one lower locking ledge on the retaining body that interacts with the at least one lower locking element when the strap connector is pulled away from the top opening, to prevent the strap connector from being removed from the retaining body; and an upper locking element on the strap connector and at least one upper locking protrusion on the retaining body, the upper locking element comprising an indentation in the adjustment portion, wherein when the spring is in a relaxed state, the at least one protrusion prevents movement of the strap connector in the horizontal direction by blocking the at least one lower locking element, wherein pressing the strap connector against a force of the spring moves the lower locking element below the at least one protrusion, so that the strap connector can be moved in the horizontal direction to a new position within the retaining body, wherein the at least one upper locking protrusion seats in the indentation and further prevents removal of the strap connector from the retaining body when the strap connector is pulled away from the top opening, and wherein the adjustment device is configured such that in the relaxed state, the spring presses the upper locking element against the at least one upper locking protrusion, and presses the at least one lower locking element against the at least one lower locking ledge, to prevent movement of the strap connector within the retaining body.

* * * * *